United States Patent [19]

Mathou

[11] 4,345,666

[45] Aug. 24, 1982

[54] SOUND-DAMPING ASSEMBLY FOR A STRUCTURE OF A PIECE OF FURNITURE

[76] Inventor: Marcel Mathou, 12630 Gages, France

[21] Appl. No.: 200,055

[22] Filed: Oct. 23, 1980

[30] Foreign Application Priority Data

Nov. 7, 1979 [FR] France ..... 79 27502

[51] Int. Cl.[3] ..... F16F 15/00

[52] U.S. Cl. ..... 181/207; 297/DIG. 2

[58] Field of Search ..... 181/207–209, 181/284–286, 175; 211/27, 182, 183; 297/DIG. 2; 248/345.1; 52/144, 145

[56] References Cited

U.S. PATENT DOCUMENTS

| | | | |
|---|---|---|---|
| 2,119,434 | 5/1938 | Henken . | |
| 3,970,401 | 7/1976 | Lubeck | 297/DIG. 2 X |
| 3,971,447 | 7/1976 | Ahlberg et al. | 181/207 X |
| 4,273,213 | 6/1981 | Munz | 181/207 |

FOREIGN PATENT DOCUMENTS

| | | |
|---|---|---|
| 1554454 | 1/1970 | Fed. Rep. of Germany . |
| 1529619 | 11/1970 | Fed. Rep. of Germany . |

*Primary Examiner*—L. T. Hix
*Assistant Examiner*—Benjamin R. Fuller
*Attorney, Agent, or Firm*—Cushman, Darby & Cushman

[57] ABSTRACT

The assembly comprises a structural member, for instance one made out of wood, surrounded by a sheath member made out of rigid or semi-rigid plastic material, the outer contour of said core member and the inner contour of said sheath member being established to provide space or play therebetween forming a damping cushion, said members being interconnected by zones of reduced area. In a typical embodiment, the inner core member has longitudinally extending grooves formed in the periphery thereof defining ribs therebetween the peripheral contour of which generally corresponds to the inner contour of the sheath member.

12 Claims, 4 Drawing Figures

SOUND-DAMPING ASSEMBLY FOR A STRUCTURE OF A PIECE OF FURNITURE

FIELD OF THE INVENTION

The invention relates to pieces of furniture and more particularly to sound-damping assemblies of structural members in pieces of furniture.

BACKGROUND OF THE INVENTION

Modern pieces of furniture such as chairs, tables, step-ladders or ladders show, regardless of the material constituting the structural members of said pieces of furniture, pronounced idiophonic effects when bumped one against another or against stationary structures, as can be appreciated when setting up banquet or exhibition halls or where one is in schools, particularly in infant schools. By idiophonic effect what is meant is the intrinsic sound-giving or resonant character of solid structural members of pieces of furniture when bumped, an effect utilized and amplified, for instance, in wood tom-toms. For aesthetic and protective purposes, and also for facilitating their maintenance, modern pieces of furniture often comprised structural members which are at least partially externally coated by a sheathing which is obtained either by depositing an enamelled coating material thereon or by applying on the members a thin sheath of plastic material. The adjunction of such a thin sheath to the structural member to which it closely adheres does not modify the proper configuration of said structural member and reduces only by a very modest extent the drawbacks of the above-mentioned idiophonic effects.

OBJECTS OF THE INVENTION

An object of the invention is to obviate such drawbacks by providing an assembled structure for a piece of furniture which comprises an assembly of a structural member and an outer sheathing member formed out of rigid or semi-rigid material arranged around said structural member in a stationary fixed relationship therewith which permits, without increasing the manufacturing costs and without reducing the mechanical strength of the structure, the achievement of a noticeable phonic damping thereby reducing the idiophonic effects while further permitting a substantial reduction in weight of the structure.

Another object of the invention is to provide a structure of the above character permitting a wide range of utilization, particularly by rendering the outer aspect of the structure, as determined by the sheath members, relatively independent of the configuration of the structural members which act either as pulling or supporting members and which serves as the supporting framework of the piece of furniture. At the same time, the surrounding sheath adds to the mechanical strength of the structure, more particularly when several such structures are assembled in a framework.

In order to accomplish these and other objects, according to the invention, the elongated structural member and sheathing member are shaped and positioned in mutual relationship so as to provide over a major portion of the interface between said members spacing or play forming a damping cushion.

According to another feature of the invention, the members have relative cross-sections whereby, in assembled mutually contacting position, spacing or play is provided on the major portion of the outer periphery of the inner structural member between said member and the inner periphery of the outer sheathing member.

According to a preferred embodiment, the structural member, which is advantageously made out of wood, is formed on its periphery with longitudinal grooves extending over its length to define ribs having a peripheral contour corresponding substantially to the inner contour of the sheathing member which is advantageously made out of rigid or semi-rigid coloured plastic material.

BRIEF DESCRIPTION OF THE DRAWINGS

Other objects of the present invention will appear from the following description of different illustrative embodiment of the invention when considered with reference to the accompanying drawings, wherein.

DETAILED DESCRIPTION OF PREFERRED EMBODIMENTS

Figure 1:
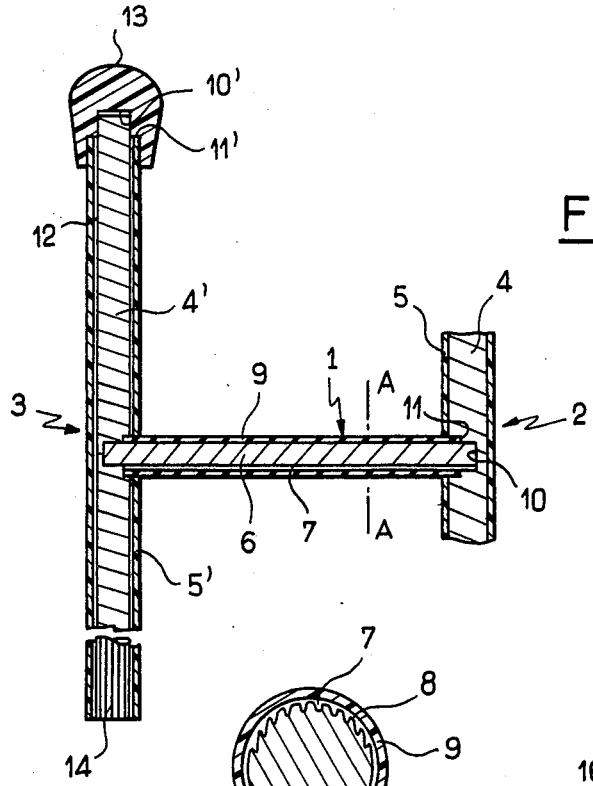
FIG. 1 schematically illustrates an assembled structure of a piece of furniture utilizing assembled members according to the invention.

There is schematically shown in FIG. 1 a piece of furniture, such as a portion of a ladder or a chair, which comprises a cross-bar or rung 1 interconnecting two uprights or legs 2,3. For illustrative purposes, the upright 2 at the right portion of FIG. 1 is of a known configuration, having a smooth cylindrical core 4 coated with a thin sheath formed of plastic material 5.

Figure 2:
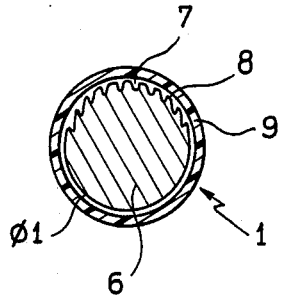
FIG. 2 is a sectionary view along the line A—A of the cross bar or rung of FIG. 1.

According to the invention, the cross-bar 1, also illustrated in FIG. 2, comprises a first structural member or core 6 of generally cylindrical shape, advantageously made out of wood, which is formed, on its periphery, with longitudinally extending grooves 7 which are carved, for instance by toothed jaws when forming the cylindrical member 6. The circle defined by the peripheral surfaces of the longitudinally extending ribs 8 is slightly less than the inner diameter of the rigid or semi-rigid tubular sheath 9, made advantageously out of acrylonitrile-butadiene-styrene or high density polyethylene, which is fixed on the structural member 6. With such an arrangement, it will be understood that the contact zones between the core 6 and the sheath 9 come down to the thin generatrices of the ribs 8 whereby, when the bar 1 is bumped, only a very limited portion of the pressure wave is transmitted to the solid core 6, thus providing for an idiophonic effect reduced by at least 20 dB with respect to the conventional structure, such as the upright 2. Thus, with such an arrangement, there is provided between the peripheral surface of the core 6 and the inner surface of the sheath 9 an air cushion, constituted by the numerous grooves 7 all around the core 6, occupying the major portion of the interface between the core 6 and the sheath 9. In FIG. 2, the groove and ribs 7 and 8 are only illustrated on a half portion of the core but it should be noted that they are actually formed over the entire periphery of the core.

In the assembly of FIG. 1, the bar 1 has its end received within stepped recesses formed within the uprights 2 and 3, said stepped recesses comprising a deeper central bore 10 for receiving the end of the core 6 and an inlet peripheral coaxial bore 11 of reduced length and enlarged diameter for receiving the end of the sheath 9, whereby the sheathes 5 or 5' of the uprights 2,3 have an opening cut to correspond to the diameter of said latter peripheral bore 11. The cross-bar 1 is connected similarly to the left upright 3 in FIG. 1, said latter upright, however, being constructed according to the invention with a smooth cylindrical core 4' having an outer diameter smaller than the inner diameter of the sheath 5' and made out of a rigid plastic material, the relative positioning of said members being obtained, in order to provide therebetween on almost the entirety of the interface, an air cushion in the form of a cylindrical spacing 12, either by cup-shaped mouth pieces 13 advantageously made out of semi-rigid rubber material having stepped recesses 10' and 11' analogous to the stepped recesses in the upright 2, or, as shown more particularly at the lower end of upright 3, by providing the cylindrical core 4' with a splined or grooved end portion of enlarged diameter 14 in an arrangement similar to that illustrated in FIG. 2. It will be understood that the left upright 3 may include a core 4' formed all over its length with longitudinally extending grooves, as in the case of core 6 of the cross-bar 1, the mouthpiece being then a mere protective cover.

Figure 3:
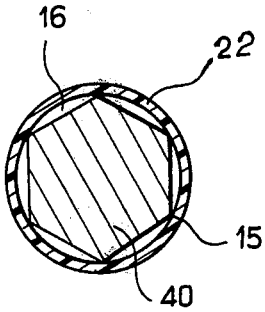
FIG. 3 is a similar sectional view of another embodiment of such a bar or rung.

In the construction of the left upright 3 in FIG. 1, the core 4' has a section which is spaced from the tubular sheath 5' but, as illustrated in FIG. 3, the core 40 may have a polygonal cross-section the outermost peripheral surfaces of which bear against the inner surface of the tubular sheath 22 centering core 40, whereby air cushions 16 are defined which occupy more than 95% of the interface between the inner structural member 40 and the outer sheath 22.

Figure 4:
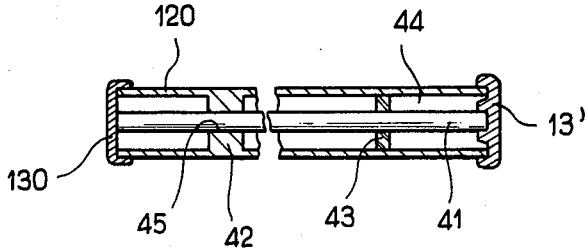
FIG. 4 illustrates alternative embodiments of an assembled structure for a piece of furniture according to the invention.

There is illustrated in FIG. 4 a further development of the embodiment of the invention. In said embodiment, the structural member or inner core 41, which is advantageously a metallic tube or shaped section, has a diameter or, more generally, an outer contour, having dimensions substantially less than the cylindrical or polygonal inner contour of the sheath 120 formed of rigid material, for instance plastic material. At the left portion of FIG. 4, the connecting means between the inner and outer members consists of bracing fins 42 extending radially inwardly from the inner surface of the sheath 120, integral therewith, to define an annular central bearing surface 45 for the core 41, the thus realized assembly being closed at one end by a cover cup 130. At the right portion of FIG. 4, the connecting means between the inner and outer members comprises annular braces 43, formed for instance out of rigid plastic material or semi-rigid rubber, which braces are fitted onto the core 41, the sheath 120 being interiorly fixed to said braces 43. As in the case of the upper end of the left upright 3 in FIG. 1, the relative positioning of the core 41 within the sheath 120 may be further achieved at the end of the assembled structure by a cover cup 13' having annular concentric recesses for receiving the ends of the sheath and the core, respectively.

The embodiment having a grooved core which is illustrated in FIGS. 1 and 2 further provides for significant advantages in mounting the cross-bar 1 on the perpendicularly extending uprights 2 or 3 in that the grooves 7 at the end of the core allow for a convenient forcing and distribution of glue, previously deposited within the deeper bore 10, when the cross-bar is fitted within the upright.

It should be understood that the described embodiments are merely illustrative of the application of the principles of the invention. Obviously, many modifications may be made without departing from the spirit and scope of the invention as set forth in the following claims. More particularly, depending upon the requirements, the space or play between the inner core and the outer sheath may be, at least locally, filled with finely divided or multi-cellular filling materials, thereby increasing the phonic damping properties and also the mechanical strength of the piece of furniture.

What I claim is:

1. A sound-damping structure assembly for use as a structural component of a piece of furniture, which comprises a first elongated structural member and a second sheathing member having substantially the same length as said first member and surrounding same, wherein said second member is made out of a rigid or semi-rigid material, said first and second members having, in cross-section, relative outer and inner contours, respectively, whereby in assembled relationship a damping air cushion is formed on the major portion of the interface between said outer contour of said first member and said inner contour of said second member.

2. The assembly of claim 1, wherein the relative positioning of said first and second members in assembled relationship is achieved at least partially by separate connecting means interconnecting locally said first and second members.

3. The assembly of claim 2, wherein said connecting means are end mouthpieces.

4. The assembly of claim 2, wherein said connecting means comprises another structural member extending in an angular direction with respect to said first structural member to which it is assembled.

5. The assembly of claim 4, wherein said other structural member is surrounded by a sheathing member which is locally cut for receiving said sheathing member associated with said first structural member.

6. The assembly of claim 1, wherein said first member is formed on its periphery with longitudinally extending grooves separated by rib portions, the contour of the peripheral surfaces of said rib portions corresponding substantially to said inner contour of said second member

7. The assembly of claim 6, wherein said sheathing member is tubular.

8. The assembly of claim 6, wherein said sheathing member is a plastic material.

9. The assembly of claim 1, wherein said structural member is made out of wood.

10. A sound-damping assembled structure for use as a structural component of a piece of furniture, which comprises a structural core member surrounded by a tubular sheath member made out of a rigid or semi-rigid plastic material, the outer contour of the core member and the inner contour of said sheath member defining therebetween, when said members are assembled, a space forming a damping air cushion extending over more than 90% of the interface between said outer contour of the core member and said inner contour of the sheath member, and connecting means being provided for locally interconnecting said first and second members over surfaces of reduced area.

11. The assembly of claim 10, wherein said outer contour of said core member is defined by outwardly extending protrusions having distal ends of reduced area through which said core member is in bearing engagement with said inner contour of said sheath member.

12. The assembly of claim 11, wherein said core member has an outer contour substantially mating said inner contour of said sheath member, said core member being formed on its periphery with grooves defining therebetween ribs forming said outwardly extending projections.

* * * * *